US007305715B2

(12) United States Patent
Orsos

(10) Patent No.: US 7,305,715 B2
(45) Date of Patent: Dec. 11, 2007

(54) BATHING SUIT WITH FLOTATION SURVIVAL FEATURE

(75) Inventor: Harry Joseph Orsos, Lima (PE)

(73) Assignee: Harry J. Orsos, Lima (PE)

( * ) Notice: Subject to any disclaimer, the term of this patent is extended or adjusted under 35 U.S.C. 154(b) by 578 days.

(21) Appl. No.: 10/745,510

(22) Filed: Dec. 29, 2003

(65) Prior Publication Data

US 2005/0138716 A1 Jun. 30, 2005

(51) Int. Cl.
*A41D 7/00* (2006.01)

(52) U.S. Cl. ..... 2/67; 441/108

(58) Field of Classification Search ..... 2/2.15, 2/69, 82, 227, 228, 238, 67, 247, 250, 251, 2/DIG. 3; 441/80, 88, 102, 106, 114, 115, 441/119, 121, 122, 123, 93, 108, 116, 120, 441/132

See application file for complete search history.

(56) References Cited

U.S. PATENT DOCUMENTS 1,457,264 A * 5/1923 Panalle ..... 441/102
1,672,763 A * 6/1928 Knapp ..... 441/102
1,704,197 A * 3/1929 Journey ..... 441/92
2,463,641 A * 3/1949 Podell ..... 441/93
2,490,556 A * 12/1949 Spack ..... 441/120
2,524,212 A * 10/1950 Spack ..... 441/120
2,615,182 A * 10/1952 Podell ..... 441/113
3,098,248 A * 7/1963 Geier ..... 441/120
3,130,424 A * 4/1964 Santangelo ..... 441/94
3,134,993 A * 6/1964 McCoy ..... 441/102
3,646,625 A * 3/1972 Geier ..... 441/121
3,935,608 A * 2/1976 Freedman et al. ..... 441/92
D245,882 S 9/1977 Siddons
4,619,622 A * 10/1986 McDonald et al. ..... 441/111
4,626,221 A * 12/1986 Rocco ..... 441/108
4,968,277 A * 11/1990 Parish et al. ..... 441/93
5,022,879 A 6/1991 DiForte
5,030,153 A * 7/1991 Bailey ..... 441/115
5,368,512 A 11/1994 Brown
5,382,184 A * 1/1995 DiForte, Jr. ..... 441/108
5,393,254 A * 2/1995 Ducheshe ..... 441/118
5,413,485 A * 5/1995 Adee ..... 434/254
5,454,744 A * 10/1995 Seiler ..... 441/109
5,466,179 A * 11/1995 Jeffrey, Sr. ..... 441/108
5,500,952 A * 3/1996 Keyes ..... 2/465
5,502,842 A * 4/1996 Wagner ..... 2/67
5,516,320 A * 5/1996 LaPlant ..... 441/106
5,638,550 A * 6/1997 Hube ..... 2/311
5,702,279 A * 12/1997 Brown ..... 441/108
5,738,557 A 4/1998 Biesecker
5,778,451 A * 7/1998 Rhea ..... 2/67
5,820,432 A * 10/1998 Wright ..... 441/119
5,879,213 A 3/1999 Williams, Jr.
5,911,612 A * 6/1999 Steger ..... 441/118
6,088,832 A * 7/2000 Newman ..... 2/67

(Continued)

FOREIGN PATENT DOCUMENTS

DE 2837497 A * 3/1980

(Continued)

*Primary Examiner*—Alissa Hoey

(57) ABSTRACT

A bathing suit incorporates two life-saving inflatable bladders stored in pockets located in the front of the suit at waist level. When needed, the bladders can be rapidly inflated and deployed to a collarlike configuration which will keep the wearer's head above water.

6 Claims, 6 Drawing Sheets

U.S. PATENT DOCUMENTS 6,112,327 A * 9/2000 Shaffer ..... 2/67
6,231,411 B1 * 5/2001 Vinay ..... 441/120
6,260,199 B1 * 7/2001 Grunstein et al. ..... 2/69
6,564,387 B1 * 5/2003 Willoughby ..... 2/69
7,033,237 B2 * 4/2006 Spagnuolo ..... 441/108
7,150,668 B2 * 12/2006 Kemp ..... 441/106

FOREIGN PATENT DOCUMENTS

GB 2162129 A * 1/1986

* cited by examiner

BATHING SUIT WITH FLOTATION SURVIVAL FEATURE

BACKGROUND OF THE INVENTION

1. Field of the Invention

This invention concerns a bathing suit having easily deployable emergency flotation means to prevent drowning of a swimmer.

2. Description of the Prior Art

Numerous types of inflatable personal flotation devices have been disclosed to provide buoyancy to a swimmer for survival or rescue purposes. Such devices include structures such as circular tubes that a swimmer holds onto and devices such as inflatable vests which are worn by the swimmer.

Such flotation devices are generally considered to be accessory safety equipment, and maintained in a storage or ready state easily accessible or deployable in an emergency situation. Typical emergencies include for example the capsizing of a boat, or a person falling overboard.

In the case of a recreational swimmer in a large body of water, the use of flotation devices of the prior art would constitute a considerable impediment to proper or pleasurable swimming. However, there is need for flotation means to achieve survival of the swimmer in emergency situations such as unforeseen strong currents or high waves, or physiological problems such as exhaustion or muscle cramps. Satisfactory flotation means must not only increase the swimmer's buoyancy, but must be quickly and easily deployable, and must position the swimmer's face upwardly so that, even if unconscious, proper breathing will be facilitated. In order to create a greater degree of safety, the flotation means should preferably be of a nature which eliminates discretionary decision as to whether or not such means should accompany the swimmer.

U.S. Design Patents 245,881 and 245,882 to Siddons disclose a swimming suit of full torso style having strap portions that embrace the shoulders of the wearer. The Siddons swimming suit is equipped with two separate inflatable bladders, one built into the stomach region of the suit and one detachably associated with the upper front of the suit. The detachable bladder is in the form of a collar adapted to include the wearer's neck.

U.S. Pat. Nos. 5,368,512 and 5,702,279 to Brown disclose inflatable swimmer's safety belts adapted to be inflated by a cartridge of compressed gas. The Brown devices are discretionary add-on attachments which a swimmer may choose not to employ.

An important factor in swim wear is its appearance, particularly outside the water, as on a public beach. A person wearing a bathing suit would like to project a reasonably conventional appearance, and would not want to publicize the fact that he is so concerned about safety that his bathing suit is equipped with special life-saving features. Prior bathing suits which incorporate flotation means have distinctly unconventional appearances which are conspicuous in public paces, and may cause embarrassment to the wearer.

It is accordingly an object of the present invention to provide a bathing suit of conventional appearance having incorporated therein an inflatable safety device.

It is another object of this invention to provide a bathing suit as in the foregoing invention which does not interfere with normal movements of a swimmer.

It is a further object of the present invention to provide a bathing suit of the aforesaid nature wherein said safety device may be quickly and easily deployed to an inflated state.

It is a still further object of this invention to provide a bathing suit of the aforesaid nature wherein said safety device, when deployed, fits around the swimmer's neck so as to position the swimmer's face upwardly.

It is yet another object of the present invention to provide a bathing suit of the aforesaid nature which is of durable, simple construction amenable to low cost manufacture.

These objects and other objects and advantages of the invention will be apparent from the following description.

SUMMARY OF THE INVENTION

The above and other beneficial objects and advantages are accomplished in accordance with the present invention by a bathing suit consisting of a fabric short garment having an upper waistband and two descending leg portions bounded in part by opposed front and rear surfaces, said bathing suit having an upwardly opening pocket disposed in each front surface of said leg portion adjacent said waistband, each pocket confining a rolled up elongated tubular inflatable bladder having a proximal extremity which is attached to said bathing suit, and a distal extremity having means for interengaging the distal extremity of the other bladder, said bladders being adapted to be unrolled to a deployed state in the direction of the wearer's head.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
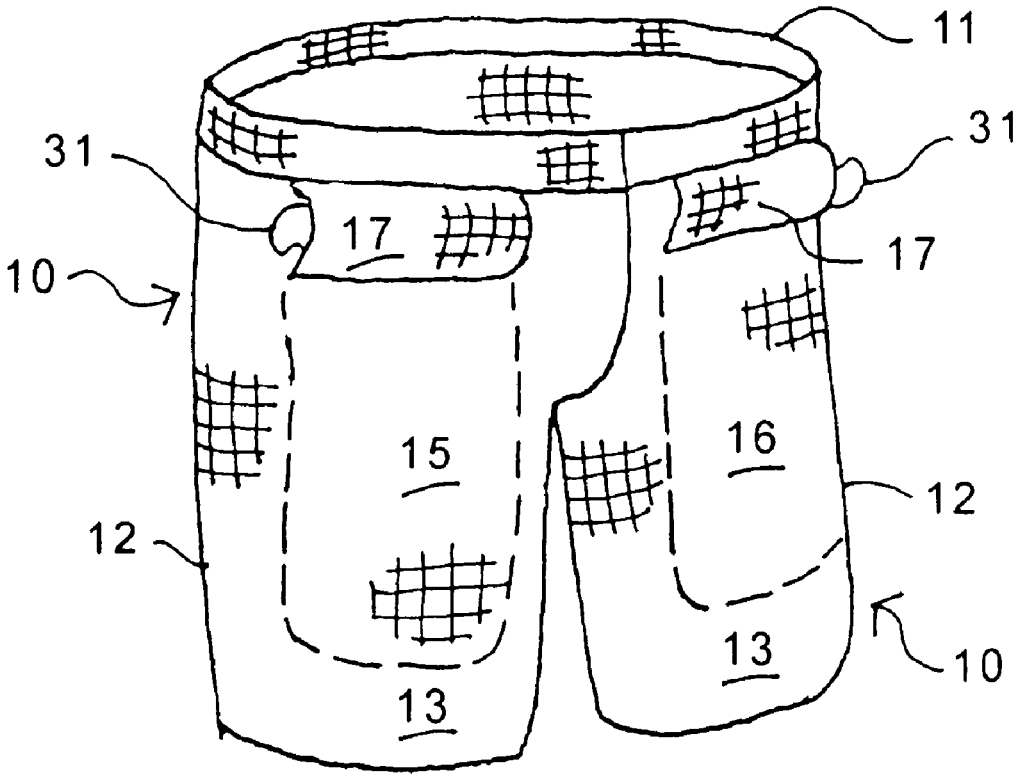
FIG. 1 is a front perspective view of an embodiment of the bathing suit of the present invention shown with both inflatable bladders in their concealed, storage state within pockets.
Figure 2:
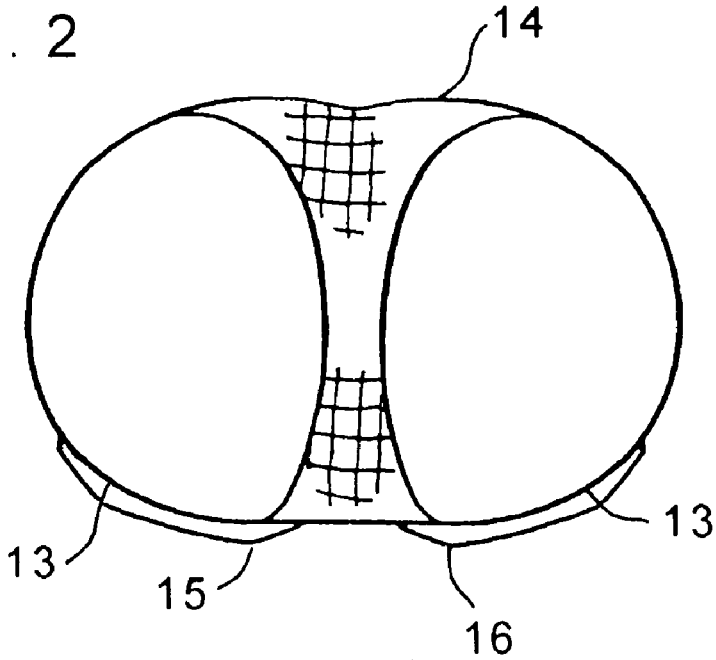
FIG. 2 is a top view of the embodiment of FIG. 1.
Figure 3:
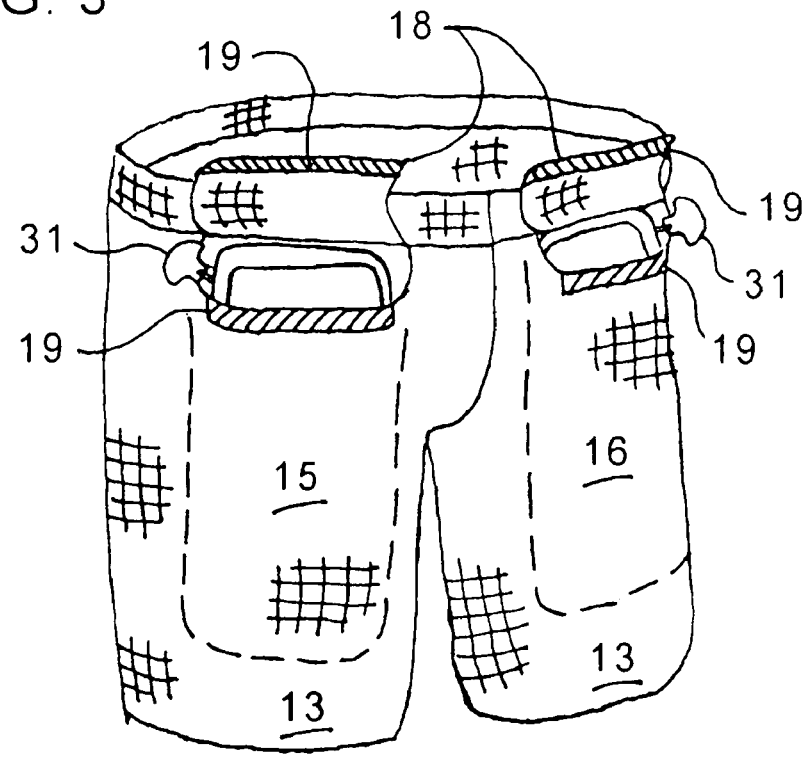
FIG. 3 is a front perspective view of the embodiment of FIG. 1 shown with both pockets open to permit removal of the stored bladders.
Figure 4:
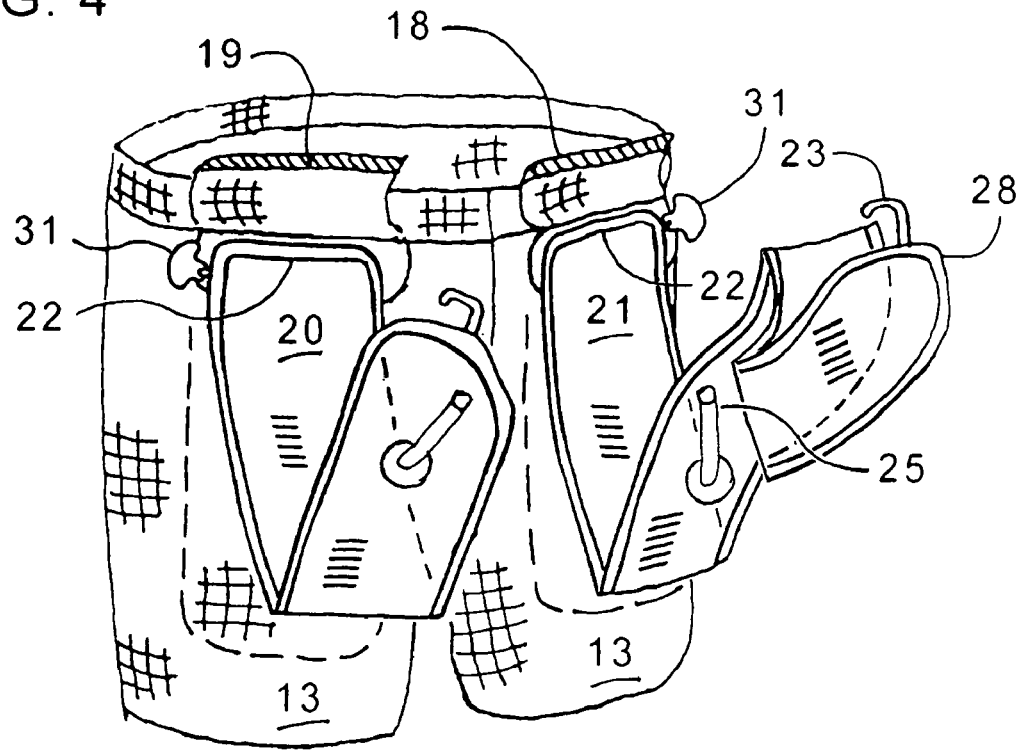
FIG. 4 is a view similar to FIG. 3 showing the bladders in their initial state of deployment.

Referring now to FIGS. 1-8, an embodiment of the bathing suit 10 of the present invention is shown in the form of shorts consisting of a fabric garment having an upper waistband 11 and two descending leg portions 12 bounded in part by opposed front and rear surfaces 13 and 14, respectively. Said waistband may contain securing means such as a drawstring or elasticized material to maintain the shorts upon the swimmer's waist.

Pockets 15 and 16 are disposed in the front surfaces of each leg portion adjacent waistband 11, and are configured to open upwardly. A closure flap 17 is associated with the upper extremity of each pocket. The free extremity 18 of each flap has retaining means 19 which permit secure closure of the pocket while permitting rapid opening thereof.

A particularly suitable retaining means is hook and loop securement material generally available as VELCRO, a product of Velcro USA of Manchester, N.H. Such hook and loop attachment or fastening material are paired interactive members, each comprising a compliant base sheet having an upraised pile of synthetic fibers. The fibers of one member are in the form of loops. The fibers of the other interactive member are cut loops, which constitute hooks. When the two members of the fastening system are pressed together in face-to-face relationship, there is substantial engagement of hook fibers with loop fibers. A considerable effort must be applied to separate the members unless they are peeled apart, in which event the members are easily separated.

Pocket 15 contains a first elongated tubular inflatable bladder 20 in a rolled up, storage state. Pocket 16 contains a second elongated tubular inflatable bladder 21 in a rolled up, storage state. Said bladders may be fabricated of rubbery sheet material or of plastic film. Each bladder has a proximal extremity 22 which is attached to said bathing suit, and a distal extremity 28 having interengaging means 23 for joining the distal extremity of the other bladder. Said interengaging means may be hooks, VELCRO attachment material, or other equivalent mechanisms.

Figure 5:
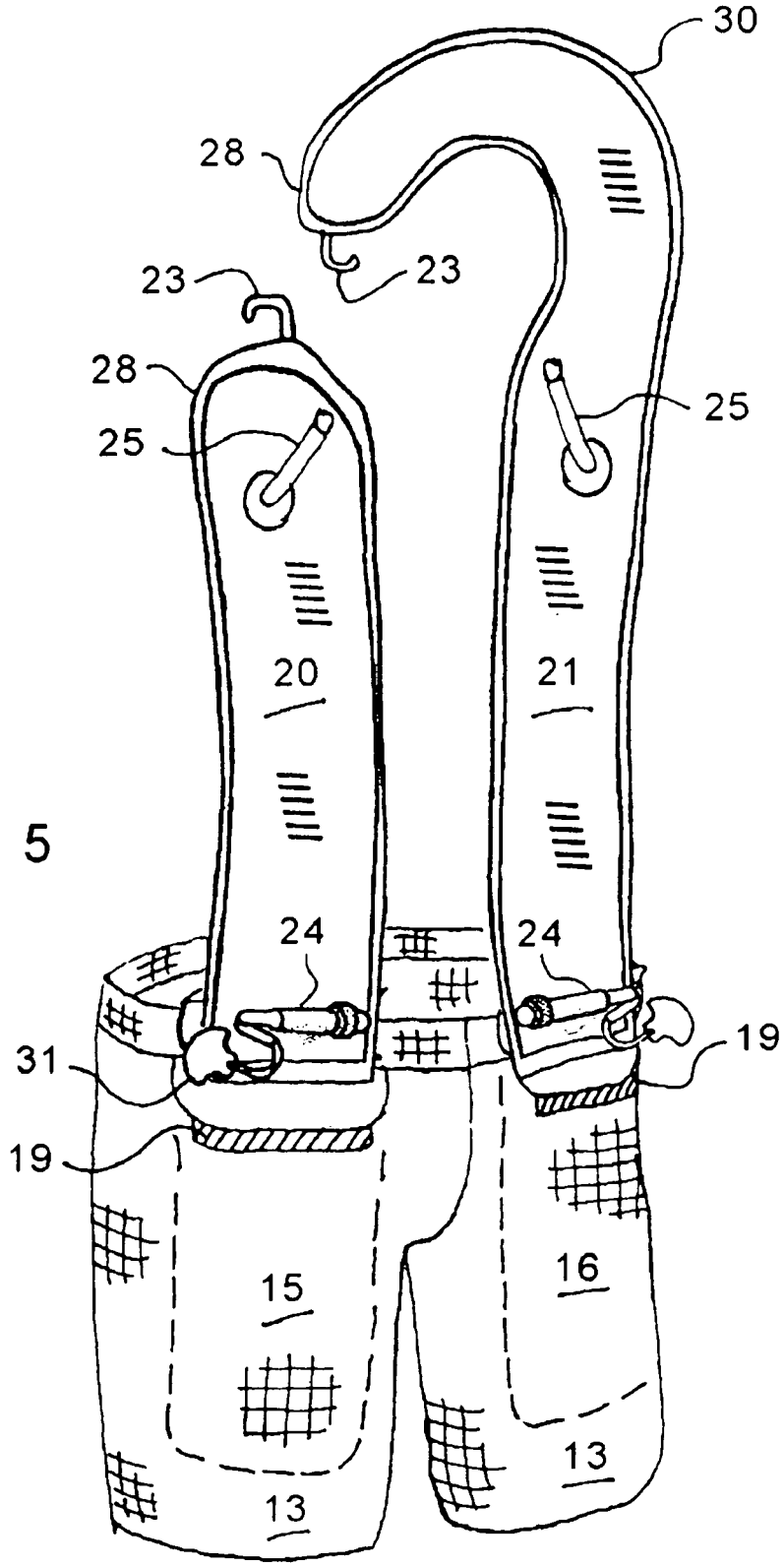
FIG. 5 is a view similar to FIG. 3 showing both bladders fully extended upwardly.
Figure 6:
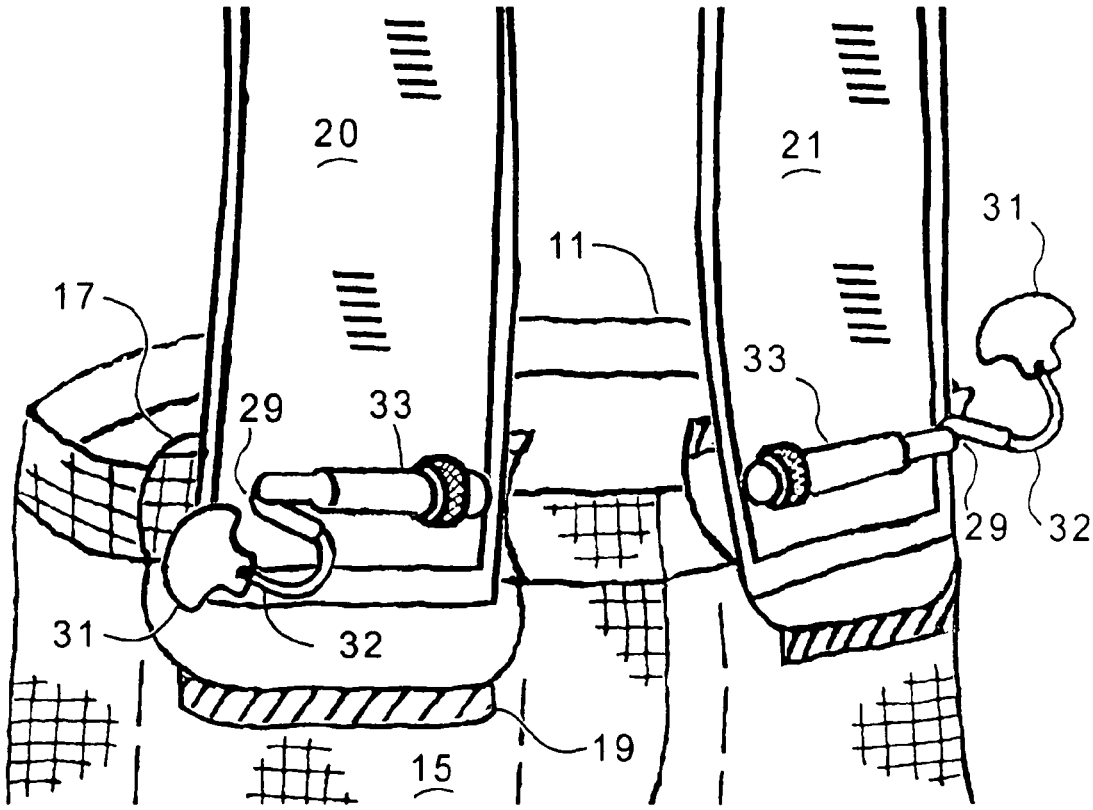
FIG. 6 is an enlarged fragmentary view of FIG. 3.

As best shown in FIGS. 5 and 6, an inflating device 24 in the form of a cylinder of a compressed gas 33 and associated trigger mechanism 29 is associated with each bladder adjacent its proximal extremity. It is preferable that the trigger mechanism is configured and positioned such that it facilitates the lifting of closure flap 17. In a particularly preferred embodiment, a pull tab 31 is associated with the trigger mechanism, and a string 32 is interactive between tab 31 and flap 17 to cause lifting of the flap when the tab is pulled. An orally operable inflation valve 25 is associated with each bladder adjacent its distal extremity, or otherwise placed so as to be conveniently accessible to the user's mouth. Said inflation valve may be utilized, as shown in FIG. 7*h*, in the event that inflating device 24 malfunctions.

It is preferable that one of the bladders has a length greater than the length of the other bladder. As shown in the exemplified embodiment, first bladder 21 is longer than second bladder 20. By virtue of such configuration, said first bladder is able to extend around the back of the wearer's neck. Also, the site 26 where the distal extremities of the bladders meet is caused to be conveniently located in front of the wearer instead of behind the wearer's neck. In some embodiments, the longer bladder may have a curved shape 30 adjacent its distal extremity so as to more comfortably fit around the user's neck.

Figure 7:
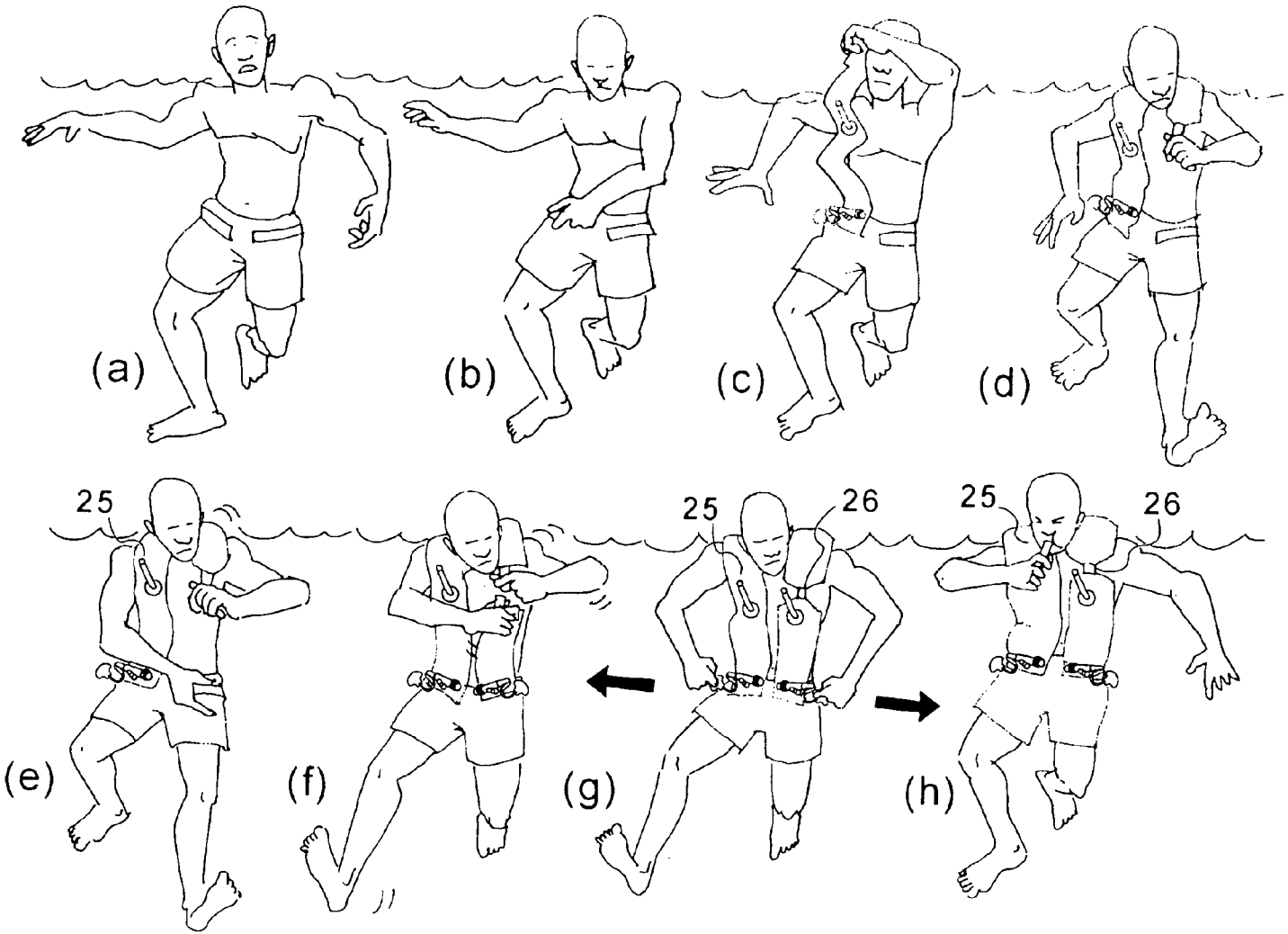
FIGS. 7*a-h* show the steps involved in a procedure for achieving full deployment of both bladders from their storage state to their functionally buoyant state.

When in need, the swimmer will lift the flaps of both pockets and upwardly unwind the bladders of each compartment as shown in FIG. 7. The longer of the two bladders will be passed around the back of the user's neck, and the distal extremities will be joined by said interengaging means. Both bladders will then be separately inflated by either the compressed gas cartridge, as shown in FIG. 7*g* or oral inflation valve 25, as shown in FIG. 7*h*.

Figure 8:
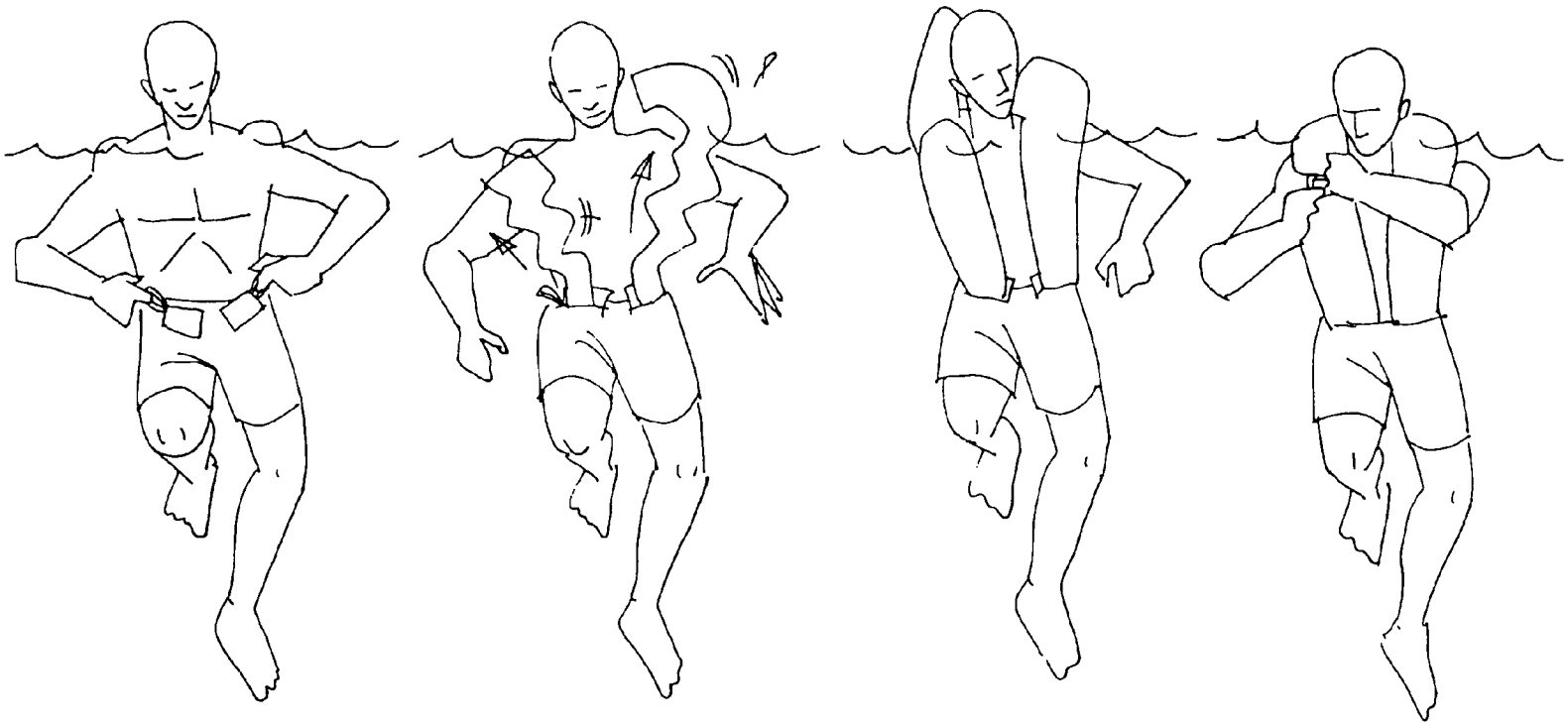
FIGS. 8*a-d* show the steps involved in an alternative procedure for achieving full deployment of both bladders from their storage state to their functionally buoyant state.

In the alternative method of deployment illustrated in FIG. 8, the swimmer initially inflates both bladders, then interconnects the bladders such that the longer bladder fits around the back of his neck. This method of deployment has the advantage of providing an immediate buoyancy effect.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. A bathing suit consisting of a fabric short garment having an upper waistband and two descending leg portions bounded in part by opposed front and rear surfaces, said bathing suit having an upwardly opening pocket disposed in each front surface of said leg portion adjacent said waistband, each pocket confining a rolled up elongated tubular inflatable bladder having a proximal extremity which is attached to said bathing suit, and a distal extremity having means for interengaging the distal extremity of the other bladder, said bladders being adapted to be unrolled to a deployed state in the direction of the wearer's head;

a first of said bladders has a length greater than the length of the other bladder, the length of the first bladder is such so as to extend around the back of the wearer's neck;

the distal extremities of said bladder, in said deployed state, meet at a site in front of the wearer.

2. The bathing suit of claim 1, wherein each pocket has an upper extremity equipped with a closure flap.

3. The bathing suit of claim 2, wherein each closure flap has a free extremity provided with retaining means which permit secure closure of the pocket while permitting raid opening thereof.

4. The bathing suit of claim 3, wherein said retaining means comprises hook and loop fasteners.

5. The bathing suit of claim 1, wherein an inflating device having a cylinder of compressed gas is associated with each bladder adjacent the proximal extremities thereof.

6. The bathing suit of claim 5, wherein each bladder is further provided with valve means which permit oral inflation.

* * * * *